US006105978A

United States Patent [19]

Vuerchoz

[11] Patent Number: 6,105,978

[45] Date of Patent: Aug. 22, 2000

[54] SKATE BOARD WHEEL TRUCK

[76] Inventor: Dale Vuerchoz, 142 Ceder St., El Cajon, Calif. 92021

[21] Appl. No.: 09/072,594

[22] Filed: May 4, 1998

[51] Int. Cl.[7] ..... A63C 17/02

[52] U.S. Cl. ..... 280/11.27; 280/87.041; 280/87.042; 280/11.19; 280/809

[58] Field of Search ..... 280/87.041, 87.042, 280/11.19, 11.27, 11.28, 809; 301/125

[56] References Cited

U.S. PATENT DOCUMENTS 684,652 10/1901 Thomas ..... 301/125

*Primary Examiner*—Lanna Mai
*Assistant Examiner*—Hau Phan
*Attorney, Agent, or Firm*—Frank D. Gilliam

[57] ABSTRACT

The wheel truck for a skateboard has a concave curvilinear lower surface with a similar shaped axle. The axle is cast within the wheel truck. The distal wheel ends of the axle have their center line along the same plane. The wheel truck can be cast of aluminum, plastic or any other suitable material. The axle is formed of a material different than the truck casting and when cast within the truck casting provides increased support to the concave curvilinear surface of the wheel truck.

5 Claims, 1 Drawing Sheet

SKATE BOARD WHEEL TRUCK

TECHNICAL FIELD OF THE INVENTION

The present invention relates to the general art of recreation vehicles, and particular field of skateboards.

BACKGROUND OF THE INVENTION

Skateboards are commonly used for recreation and competion purposes. Typical skateboards comprise an elongated board supported on two wheel trucks comprising two wheels each. The skateboard rider balances on the board and adjusts the direction of travel by adjusting the pressure of his weight at various locations on the board.

Riders of skateboard each have a plurality of tricks that can be preformed both on a flat surface and additionally rough terrain, edges of elevated objects, rails and other small profile elongated objects.

U.S. Pat. No. 5,100,161 issued to Joseph Tillyer teaches a shock absorber system for off road or rough terrae use. This concept requires a truck system that elevates the board portion above the truck and wheel portion. The straight wheel axle is positioned on a plane substantially through the center line of the truck. A small curvilinear dip is provided in the lower surface of the truck with no mention of any practical use therefore.

U.S. Pat. No. 4,214,768 issued to David A. Dominy and Gary M. Dodds teaches the addition of a shield removably attached at the bottom of the truck to elevate truck surface to prevent actual lower truck surface wear when riding the skateboard along the shield surface.

Various other truck designs can be found in U.S. Pat. No. 4,037,852 issued to inventor Bayer et al. and U.S. Pat. No. 4,515,379 issued to Pasques.

SUMMARY OF THE INVENTION

Applicant's invention is directed to an improved skateboard wheel truck formed with a spread curvilinear configuration with the curvilinear surface extending substantially the entire space between the wheels as well as locating the inner concave surface above the centerline of the axle. These features provides improved stability to the board and rider when riding along the edges or corners of various rectilinear objects or curvilinear objects such. as rails or the like.

The advantage of the curvilinear surface allows a rider to straddle an object on substantially on the same plane as the wheel center line thus providing uniform board and rider balance.

The principal advantage of the axle having a longitudinal curved surface between the wheel attachment ends rotation of the axle relative to the truck body. Straight axles after use eventually rotate relative to the truck body making the trucks unusable.

Another advantage of the axle taking the same form as the concave curvilinear lower surface of the truck body is that no additional material need be added to the lower surface of the wheel truck to provide sufficient support for the curved surface thus reducing weight and providing a lower overall profile for added rider stability.

The object of this invention is to provide a wheel truck lower surface that provides improved board/rider balance when riding the wheel truck concave curviliner portion along a edge or curvilinear surface such as rails, a sharp corners or the like.

Another object of this invention is to curve the axle between the wheel supporting ends to prevent relative rotation between the truck body and axle.

The invention will be best understood, together with additional objects and advantages thereof, from the following description, read with reference to the drawing Figures, in which:

DETAILED DESCRIPTION OF THE PREFERRED EMBODIMENT OF THE INVENTION

Figure 1:
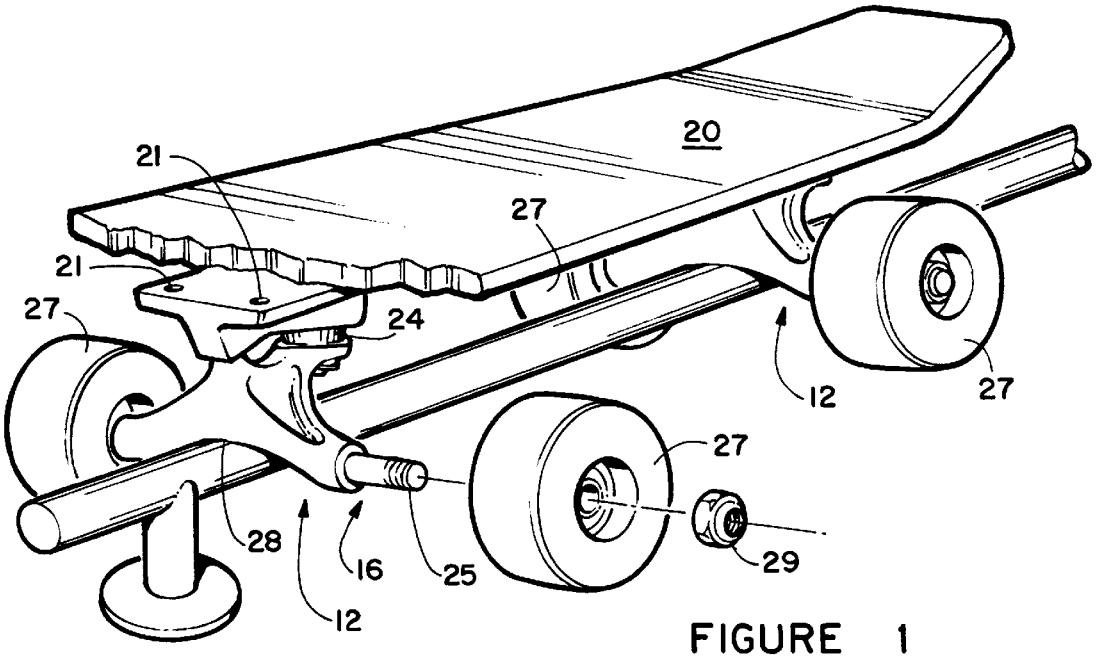
FIG. 1 depicts a perspective of a skateboard employing the wheel truck of the invention.

Referring now to the various Figures, a skateboard 10 is shown in partial cutaway exposing the front wheel truck 12. An identical back wheel truck 12 of the same configuration is also shown. Each wheel truck comprises a body portion 14, an axle 16, an attachment aperture not shown located at the upper rear and a cylindrical protrusion 18 for engaging a socket herein after described.

A wheel truck support bracket 19 is fixedly secured to the underside of the skateboard platform 20 by means of screws passing through the apertures 21 and penetrating and securing to the underside of the platform 20. After the wheel truck is bolted to the support bracket by means of a bolt 23 passing through an aperture in the support bracket 19, passing through the aperture in the wheel truck while positioning the protrusion 17 in the socket 22 in the forward portion of the support bracket and lastly threading a nut 26 to the end of the bolt 23 thereby securing the wheel truck to the bracket and attaching the bracket to the underside of the platform 20.

The wheel truck 12 is cast from any suitable material such as but not limited to aluminum, epoxy, plastic and the like suitable for the purpose intended. The main criteria is that the material be light in weight and durable.

The lower portion 28 of the wheel truck 12 has a concave curvilinear shape for the purpose of enabling the rider of the skateboard to engage in trick activities as for example sliding along curved surfaces such as, for example, a tubular rail or pipe 28 shown in drawing FIG. 1 or any edge surface such as stairs, wall edges and the like. The curvilinear surface allows the wheel truck ease of transversing such items and provides the rider a wider selection of tricks or innovations while riding the skateboard.

Figure 2:
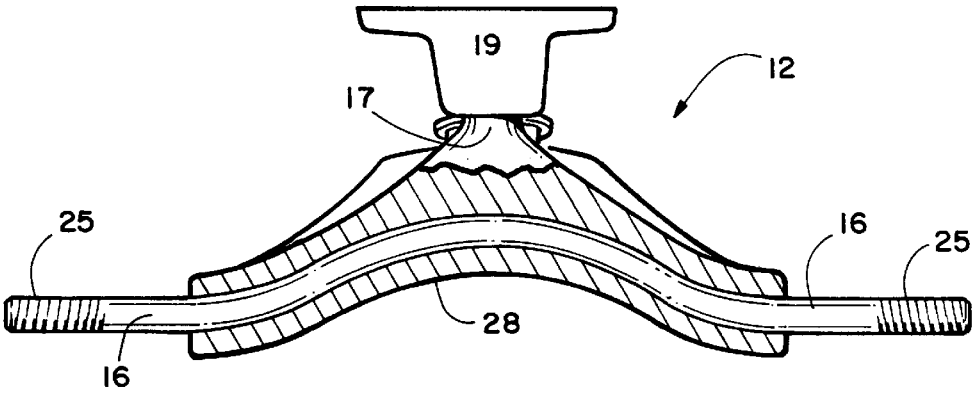
FIG. 2 depicts a front showing of the skateboard wheel truck of FIG. 1 in cutaway taken along line 2—2 of FIG. 3 exposing the axle embedded therein.
Figure 3:
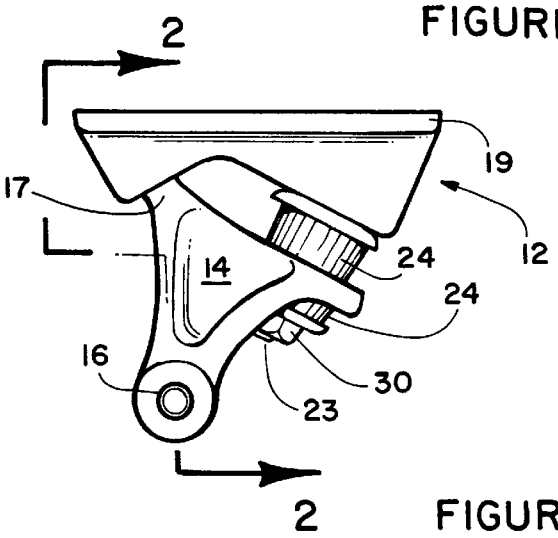
FIG. 3 depicts a side view showing of the skateboard wheel truck of FIG. 1.

In order to provide a longer life for the underside of the wheel truck along the curvilinear under portion 28 without additional mass with its added weight, the axle takes substantially the same shape of the concave curvilinear surface 28 as shown in drawing FIG. 2. This feature allows for no appreciable increase in weight and adds structural support for the curvilinear portion of the wheel truck.

The axle is constructed of any metal or other material suitable for the purpose intended. The wheel truck material is different than the material forming the axle. This feature adds structural support to the wheel truck and under surface. Ends 25 of the axle are shown with the center line of each being on the same plane and threaded for receiving and holding wheels 27 on each end thereof by means of a washer nut 29 or the like.

The materials for the support platform 20, support bracket, wheels and the various attachment means are well known in this art and not explained in detail herein.

From all of the foregoing, it will now be evident that the president invention has provided a novel concave curvilinear feature along the wheel truck bottom surface between the wheels and is further enhanced by the added feature of the axle shape being substantially the same as the curvilinear under surface of the wheel truck. Changes following within the scope and spirit of this invention will occur to those skilled in this art.

What I claim is:

1. A wheel truck for a skateboard, said skateboard having a platform and a wheel truck mounting means fixedly attached thereto for attachment of said wheel truck to the skateboard lower surface, said mounting means allowing limited relative movement between the wheel and the platform, said wheel truck comprising:

a body portion having a lower surface and an axle being cylindrical along an entire of the axle permitting a wheel to be mounted on each end thereof;

said axle having a central portion being cast within said body portion adjacent said lower surface, said axle having end portions extending from said body portion sufficiently for carrying wheels thereon;

said lower surface of said body portion having a concave curvilinear shape between and elevated above said wheel axle end portions along said concave curvilinear shape; and said central portion of said axle is formed in substantially the same shape as said body portion concave curvilinear lower surface and extending between and elevated above said end portions along concave curvilinear shape, said central portion of said axle is fully enclosed by the body portion;

wherein, the concave curvilinear lower surface of the body portion is engageable with an upper surface of an elongated rail for permitting the skateboard to travel along the rail.

2. The invention as defined in claim 1 wherein said body portion is cast from aluminum.

3. The invention as defined in claim 1 wherein said body portion is cast from epoxy.

4. The invention as defined in claim 1 wherein said body portion is cast from plastic.

5. The invention as defined in claim 1 wherein said axle is curved between the end portions and said end portions are along the same plane.

* * * * *